United States Patent [19]

Olson et al.

[11] 4,246,564

[45] Jan. 20, 1981

[54] METHOD OF ASSEMBLING A NORMALLY CLOSED THERMALLY ACTUATED CUT-OFF LINK AND THE LINK MADE THEREBY

[75] Inventors: Harry W. Olson, Woodridge; John M. Borzoni, Des Plaines, both of Ill.

[73] Assignee: Littelfuse, Inc., Des Plaines, Ill.

[21] Appl. No.: 52,396

[22] Filed: Jun. 27, 1979

[51] Int. Cl.[3] ..... H01H 37/76

[52] U.S. Cl. ..... 331/409; 337/408

[58] Field of Search ..... 337/409, 408, 407, 403, 337/402, 401, 108; 29/623

[56] References Cited

U.S. PATENT DOCUMENTS 4,109,229 8/1978 Plasko ..... 337/409

*Primary Examiner*—Harold Broome

*Attorney, Agent, or Firm*—Wallenstein, Spangenberg, Hattis & Strampel

[57] ABSTRACT

A method of assembling a normally-closed ambient thermally actuated switch comprises assembling into the open end of a casing a sandwich of elements including a meltable pellet, one or more springs, a backing member and a contact arm-deforming member which is released for movement under pressure of one of the springs when the pellet is melted at a given ambient control temperature. A power lead having resilient outwardly inclining contact arms at the inner end thereof and an axially outwardly facing shoulder is positioned in the casing so that the outer sides of the arms engage the backing member and the inner sides of the arms are confronted by the contact arm-deforming member. A rigid closure member is positioned around the power lead at the open end of the casing, where it bears against said shoulder and said sandwich of elements, and the closure member is then externally forced inwardly of the casing to bias the springs and to press the contact-forming arms of the power conductor against the backing member, to expand the same into forced engagement with the casing. This force is adjusted to provide a desired contact resistance between the contact-forming arms and the casing. The closure means is anchored in place on the casing with the adjusted force maintained on the power lead by the anchored closure member.

13 Claims, 10 Drawing Figures

METHOD OF ASSEMBLING A NORMALLY CLOSED THERMALLY ACTUATED CUT-OFF LINK AND THE LINK MADE THEREBY

BACKGROUND AND SUMMARY OF INVENTION

This invention relates to normally-closed thermally actuated cut-off links (also referred to commonly as thermal fuses, switches or cut-offs) of a type which responds to the ambient temperature surrounding the cut-off links by opening an electric circuit when the ambient temperature reaches a given control value. Such thermally actuated cut-off links, for example, are frequently physically incorporated into the windings of electric motors and in other devices requiring thermal protection and electrically connected in series with such devices so that the cut-off links will de-energize the devices involved when the ambient temperature exceeds a given safe value.

Ambient thermally actuated cut-off links have been manufactured in two different configurations, one of which is disclosed, for example, in U.S. Pat. No. 3,180,958 to P. E. Merrill, and the other of which is disclosed in U.S. Pat. No. 3,944,960 to Audette et al. In both of these types of cut-off links the ambient heat is transmitted to the interior of the link through a generally elongated cylindrically-shaped conductive casing initially closed at one end and open at the other end. A first power lead extends longitudinally into an insulating closure in the open end of the housing and terminates in a flat end making a separable contact interface with a spring metal connector member spring-urged thereagainst and having a plurality of contact-forming arm resiliently pressing against and making sliding contact with the conductive interior walls of the casing. A second power lead extends longitudinally into the closed end of the casing where it is crimped to or otherwise connected to the end wall of the casing to make a permanent inseparable low resistance engagement with the end wall. The interface of the contact-forming arms of the connector and the inside walls of the casing and the interface of the first power lead and the connector form two separable electric contacts between the power lead having a resistance much greater than than between the second power lead and the casing end wall. It is believed that at high rated currents of large electric motors or other devices requiring thermal protection heat develops at these separable contact interfaces which can appreciably affect the ambient temperature at which the link opens, which is lowered thereby.

In the type of thermally actuated cut-off link exemplified by the Merrill patent, the casing contains a sandwich of elements including a pellet of meltable material at the closed end of the casing, a first partially compressed spring, the contact-forming arm carrying connector urged against the end of the power lead passing through the open insulated end of the casing, and a second weaker partially compressed spring on the opposite side of the connector which applies a force to the connector in a direction tending to move the connector away from the power lead. When the pellet melts at the control temperature, the stronger spring expands until its force equals that of the weaker spring, and then the originally weaker spring expands to push the connector away from the end of the adjacent power lead to open the cut off link.

In the type of ambient thermally actuated cut-off links exemplified by the Audette et al patent, where deformable contacts are separated from an adjacent contact surface by an arm-deforming member (in a manner like that disclosed in an earlier U.S. Pat. No. 3,274,363 to McGirr et al), the sandwich of elements within the casing includes only a single partially compressed spring. This spring applies pressure against a meltable pellet, in turn, positioned contiguous to an arm-deforming member which, when the pellet melts, is pushed against the contact-forming arms of the connector to deform the arms inwardly away from the interior of the casing to open the fuse. In the types of cut-off links exemplified by the Merrill and Audette et al cut-off links described above, the constructions involved are such that the resistance of the contact interfaces described cannot be adjusted during or after assembly thereof, and differences in the internal resistance of what appear to be identical cut-off links, and creeping of the pellets thereof under prolong exposures to temperatures below but near the melting temperatures thereof, are believed to cause variations in the ambient temperature at which identical appearing fuses open.

There has been recently developed a normally-closed cut-off link which overcomes the aforesaid disadvantages of the prior art. This new normally-closed cut-off link comprises a cylindrical metal casing having a first power lead passing into and insulated from the casing, the power lead terminating in a pair of integral, resilient laterally outwardly inclining, deformable, contact-forming arms pressed against a backing member which expands the same against the inner surface of the casing. A second power lead is permanently connected, as by swaging, to the casing so that there is only one contact interface between the power leads, namely that between these arms and the casing. This contact interface is broken when the arms are contracted by a contact-deforming member on the inner sides of the contact-carrying arms and which is forced by spring pressure against the arms when the ambient temperature to which the link is subjected reaches a control temperature for which the link is designed. Additionally, the first power lead and contact-forming arms are preferably made of a relatively soft, very low resistance material, like silver coated copper, which, when pressed against the curved inner face of the casing, deforms somewhat to increase the contact area to minimize contact resistance.

The casing contains also a pellet of fusible material, preferably located at the initially closed end of the casing, a pair of opposed compressed spring means on opposite sides of the arm-deforming and backing members and a closure washer at the initially open end of the casing. The springs are held in a compressed state by the crimping of the casing around the closure washer while the springs are held compressed by external pressure applied to the washer. Upon the melting of the pellet, the arm-deforming member is forced by one of the springs against the contact-forming arms to bend them from the casing walls. Before the pellet melts, the force of the springs is not applied against the first power lead and associated contact-forming arms. Rather, these resilient arms are held in an expanded state against said backing member by the closure means of the casing which engage the first power lead.

After the various elements described have been inserted within the initially open end of the casing and prior to closing the open end thereof with a closure means, the first power lead and associated contact-forming arms are externally pressed inwardly toward the backing member with a progressively increasing force which spreads and forces the contact-forming arms progressively more firmly against the casing walls, until the measured contact resistance between the power leads drops to a predetermined desired value (like 0.9 milliohms when measured at 1.5" between probe points on the power leads). This adjusted force will generally provide a lower contact resistance with the casing wall than is readily achievable by the force of resilient contact-forming arms unaided by other forces, as in the above described prior cut-off links. When the contact resistance reaches this value, the power lead is anchored in its adjusted position by anchoring its closure means while it engages the first power lead. In its initially conceive form, the closure means was a curved body of epoxy material which covered and hermetically sealed the initially open end of the casing. The first power lead had one or more radial identations into which the epoxy material flowed, to aid in fixing the adjusted position of the power lead when the initially soft expoxy cement upon curing hardened.

The epoxy material forming this closure means was cured by placing the completed cut-off link in an oven heated to a desirable temperature (obviously below the desired melting temperature of the pellet of fusible material used in the cut-off link involved). The epoxy material curing process takes a relatively long period of time encompassing a number of hours and so it was necessary to maintain the adjusted external force on the contact-forming arm-carrying power lead until the curing operation was completed. This required the cut-off link-holding fixtures to remain attached to the cut-off links during the epoxy curing operation.

There was subsequently developed a different closure means making the manufacturing of the cut-off link more easy to carry out because the adjusted force on the contact-forming arms was fixed automatically upon the anchoring of a completed closure member (i.e. one not requiring any curing process to anchor the same) over the open end of the casing. This closure member comprised a preferably longitudinally split compressible resilient closure member which initially loosely enveloped the contact arm-carrying power lead extending into the casing of the cut-off link. After the power lead had been forced against the backing member so as to produce a desired measured contact resistance, the outer edges of the initially opened casing were crimped around the split closure member to compress the same tightly against the power lead, to fix the position of the power lead in the casing and to fix the pressure of the expanded contact-forming arm against the backing member and casing walls.

In our invention, an improved cut-off link construction utilizes a rigid closure member, for example, one made of a ceramic material and having an inner end which engages and is forced against a preferably laterally projecting portion of the contact arm-carrying power lead, to force the same with the desired pressure against the backing member. This rigid closure member is then fixed in position by crimping the casing around the end of the closure member.

In both forms of closure members just described, epoxy cement is applied to the lines of juncture between the closure member and the casing and first power lead, to hermetically seal these portions of the cut-off link. Since the closure member fixes the adjusted contact pressure of the cut-off link rather than the epoxy cement, the improved cut-off link can be placed in the epoxy-curing furnace without the necessity of any special pressure applying fixtures accompanying the same into the furnace.

The above-described and other objects and features of our invention will become apparent upon making reference to the specification to follow, the claims and the drawings.

DESCRIPTION OF EXEMPLARY EMBODIMENTS OF THE INVENTION

Figure 1:
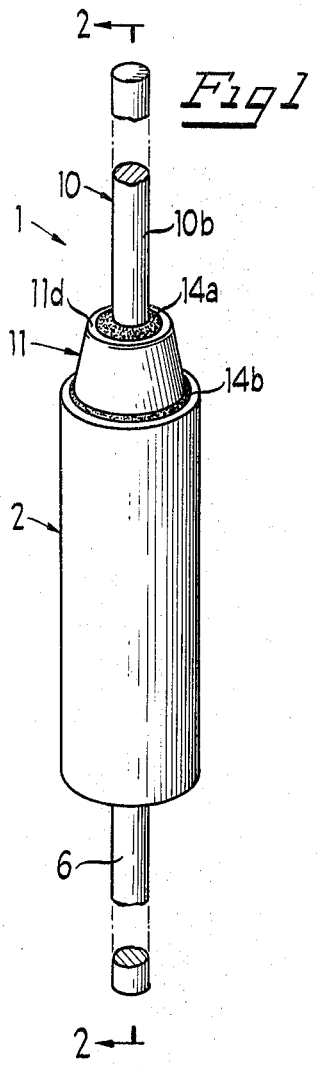
FIG. 1 is a perspective view, enlarged several times the actual size thereof, of a normally-closed ambient thermally actuated cut-off link constructed in accordance with the present invention.
Figure 2:
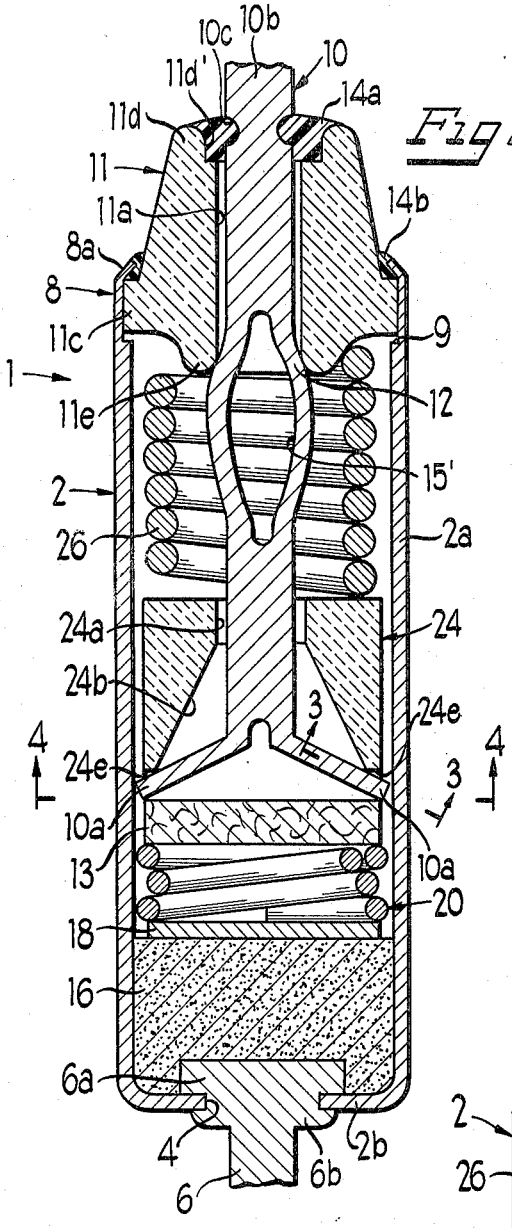
FIG. 2 is a longitudinal sectional view through the cut-off link of FIG. 1, taken along section line 2—2 therein.

Referring now more particularly to FIGS. 1 and 2, the ambient thermally actuated normally-closed cut-off link there shown and generally indicated by reference number 1 includes a metal casing 2, which may be made of brass and has cylindrical walls **2*a*, which is preferably silver plated on the inside to a thickness of about 0.0002". The casing is initially open at one end and closed by an end wall 2*b* at the other end. The end wall 2*b* has an opening 4 through which a power lead 6 passes. The power lead terminates in an enlarged head 6*a* and is swaged over the outside of the casing end wall 2*b* to form a tight, low resistance, hermetically sealed connection therewith. The power lead 6** may comprise a tin plated copper wire.

The open end of the cylindrical wall 2*a* has a reduced readily deformable skirt 8 having an end portion 8*a* swaged tightly to the flange 11*c* at the outer periphery of a rigid closure member 11 made of rigid material like a ceramic material. The closure member 11 has a central opening 11*a* through which freely passes the shank 10*b* of the power lead 10. The power lead 10 has an anchoring indentation 10*c* into which extends a body of epoxy cement 14*a* or the like which hermetically seals the end of the casing, further insulates the power lead 10 from the casing at this point and anchors the power lead 10 in an adjusted position to be described. The closure member is shown spaced from a shoulder 9 formed at the juncture between the reduced skirt 8 and the thicker portion of the cylindrical wall 2*a* of the casing 2. The closure member 11 has a bottom annular neck 11*e* which bears against an axially outwardly extending shoulder 12 formed by a bulging portion of the lead shank 10*b*.

The outer end of the closure member 11 has an annular neck portion 11*d* which defines with the shank portion 10*b* of the power lead 10 an annular well 11*d'* in which the epoxy cement 14*a* is placed. A glob 14*b* of epoxy cement is also placed over the circular line of juncture between the swaged end portion 8*a* of the casing skirt 8 and the closure member 11.

Figure 3:
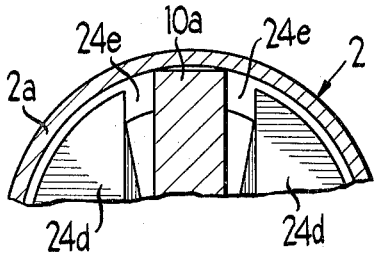
FIG. 3 is an enlarged fragmentary transverse section through the cut-off link shown in FIG. 2, taken along section line 3—3 therein.
Figure 4:
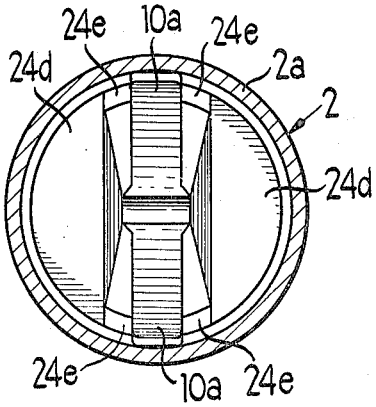
FIG. 4 is a transverse sectional view through the entire cut-off link shown in FIG. 2, taken along section line 4—4 therein.

The power lead 10 in the proposed commercial form of the invention is an annealed, 18 gauge copper wire having a tensile strength of 30,000–35,000 lbs. per square inch and a 0.0002" coating of silver thereover. The power lead 10 passes through part of a spring biased sandwich of elements to be described which extends between the closure member 11 and the end wall 2*b* of the casing 2. The power lead terminates in a pair of contact-forming arms 10*a*—10*a* at the then inner end thereof which arms are pressed by the closure member neck 11*e* against a backing member 13 which expands the arms 10*a*—10*a* into engagement with the cylindrical silver coated inner wall surface of the cylindrical wall 2*a* of the casing 2. The copper wire used to form the power lead 10 is preferably a soft readily deformable copper so that the arms 10*a*—10*a* when expanded into engagement with the silver coated inner walls of the casing 2 will deform somewhat to make contact with the casing, as best illustrated in FIGS. 2–4, ensuring an unusually total low contact resistance of, for example, under 1 milliohm per cut-off link. In the assembly of the cut-off link 1, before the split closure member 11 is anchored in place, the contact resistance between the arms 10*a*—10*a* and the casing walls is adjusted to a given desired low value by progressively increasing the inward pressure on the closure member until a measurement of this contact resistance reaches the desired value. The closure member 11 is then anchored in place by crimping the casing skirt 8 around a flange 11*c* of the closure member before the adjusted pressure is removed from the power lead. The assembly and adjustment procedure for the cut-off link 1 will be described in connection with the description of FIGS. 6–8.

The aforementioned sandwich of elements includes, in addition to the backing member 13, a pellet 16 of fusible material which will melt at a given control temperature, a metal pressure-distributing disc 18, a relatively short, strong preferably off-centered hour glass-shaped coil spring 20, an insulating arm-deforming member 24 and a relatively weak, long cylindrical coil spring 26. The coil springs 20 and 26 may be made of music wire. The pellet 16 is located between the head 6*a* of the power lead 6 and the pressure-distributing disc 18. The pellet is preferably formed by compacting a granular mixture of fusible material against the closed end of the casing. This achieves a much more intimate engagement between the fusible material and the casing walls, to increase heat conductivity to the pellet. If a self-supporting fusible pellet were to be inserted into the open end of the casing 2 during the manufacture of the cut-off link, the pellet would initially have to be of somewhat smaller dimensions than the inside diameter of the casing, which would interfere with the transmission of heat thereto through the walls of the casing if the pellet were not compacted and expanded into intimate contact with the casing wall. While a very soft pellet could be so compacted, this would not generally achieve the same intimate contact between the pellet and the casing wall as when a granulated material is compacted. Also, fusible pellets are generally relatively rigid bodies making their substantial compression difficult if not impractical to achieve when placed inside the very tiny casings used for thermal cut-off links.

The relatively short, strong, compressed hour glass-shaped coil spring 20 is shown in FIG. 2 sandwiched in a partially compressed state between the pressure-distributing disc 18 and the right side of the backing member 13. The coil spring 20 has outermost spiral turns 21 and 23 which are the coils of maximum diameter at opposite ends of the coil, and off centered turns 25 and 27 of lesser diameter between the same. These various turns of the coil are off centered in a manner so that when the coil is compressed, the contiguous portions of the turns will overlap partially and nestle together, as shown in FIG. 2, so that the longitudinal dimensions of the compressed spring are reduced from that of a conventional hour glass helical coil spring. (In the latter coil spring, the opposite halves of the coil spring are symmetrical so that the collapsing thereof will cause corresponding turns to be in alignment where they cannot nestle one within the other.) This unique spring construction enables the spring to be of a minimum size in its collapsed condition, while having the capability of following the creeping of the fusible pellet 16 and retaining sufficient force to keep the other coil spring 26 fully compressed.

The arm-deforming member 24, which is preferably made of hard ceramic material, has a pair of flat-ended bosses 24*d*—24*d* bearing against the upper side of the backing member 13 as viewed in FIG. 2. The arm-deforming member 24 is shown having a cylindrical passageway 24*a* through which the power lead 10 freely passes, which cylindrical passageway joins a conically-shaped arm-deforming cavity 24*b* which opens onto the end of the arm-deforming member 24 through an outwardly facing opening 24*c* defined between the bosses 24*d*—24*d*, and also communicates to the exterior of the member through laterally facing openings 24*e*—24*e*, which provide clearance openings for the arms 10*a*—10*a* extending outwardly beyond the confines of the arm-deforming member 24.

The relatively weak, long coil spring 26 is fully compressed between the arm-deforming member 24 by the force of the short, strong coil spring 20 which also eliminates any play in the sandwich of elements referred to. Because the coil spring 26 remains fully compressed at all times prior to the melting of the pellet 16, it is apparent that the backing member position remains fixed, and so the pressure and contact resistance between the power lead contact-forming arms 10a—10a expanded by their engagement with the backing member 13 against the casing 2 remains constant, even if the fusible pellet 16 creeps.

Figure 5:
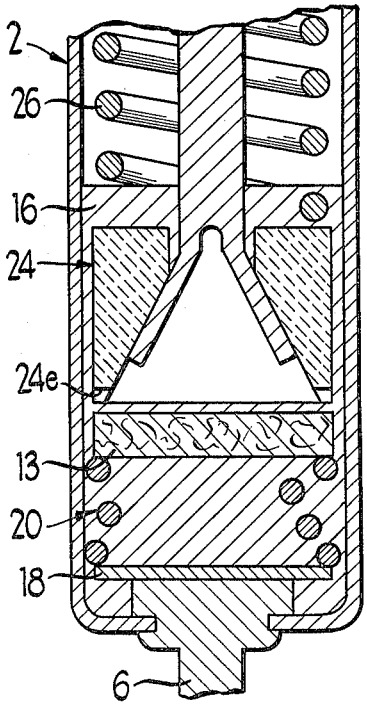
FIG. 5 is a fragmentary sectional view corresponding to FIG. 2 after the cut-off link has been blown.

When the environment in which the cut-off link is placed reaches the desired control temperature, the fusible pellet 16 melts, causing the initial expansion of the stronger coil spring 20, following which the larger coil spring 26 will fully expand to force the arm-deforming member 24 downward as viewed in the drawings. The movement of the arm-deforming member 24 downward will collapse the arms 10a—10a within the cavity 24b thereof, as shown in FIG. 5. The pressure-distributing disc 18, as well as the backing member 13 and the arm-deforming member 24, are made of a size somewhat smaller than the interior dimensions of the casing, so that there is clearance for the flow of the melted fusible material throughout the cut-off link, as illustrated in FIG. 5.

Figure 9:
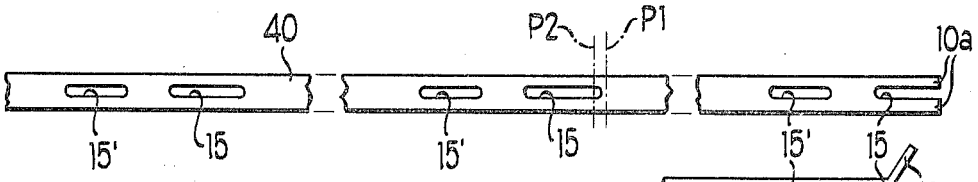
FIG. 9 is an elevational view of the end portion of a long strand of wire from which the power lead, with the integral contact-forming arms, are formed.
Figure 10:
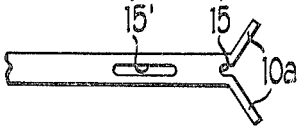
FIG. 10 illustrates the first step in forming such a power lead element at the end of the strand of wire shown in FIG. 6.

The power lead 10 can be mass produced to close tolerances in a simple manner using the fabrication steps illustrated in FIGS. 9 and 10 which reference should now be made. Individual power leads 10 are formed from the long cylindrical strand of wire 40, the end portion of which is shown in FIG. 10. Formed in this strand of wire are relatively closely spaced pairs of axially elongated apertures 15—15'. The pairs of apertures 15—15' are spaced apart so that there is sufficient wire material therebetween to form one power lead 10 and associated outwardly including contact-forming arms 10a—10a. The end portions of these apertures are rounded whereas the intermediate portions thereof preferably have parallel margins. Initially, the end of the strand of wire 40 is severed along a point like P2 so that the forwardmost aperture 15 opens onto the end of the strand of wire along parallel aperture margins. Then, the resulting wings 10a—10a defining the first aperture 15 of each pair 15—15' are bent outwardly to form the contact-forming arms 10a—10a, as shown in FIG. 10, and the wire is severed at a first point P1 which defines the outer end of the severed power lead element 10 and at a second point P2 which opens the outer end of the forwardmost aperture 15 of the next pair of apertures 15—15', so that another power lead 10 can be formed in the manner just described. Also, after a power lead 10 is passed through the arm deforming member 24, the parallel sides of apertures 15' are deformed outwardly by inserting a tool within the apertures 15', to form a resilient outwardly expanded portion of the power lead defining the aforesaid shoulder 12.

Figure 6:
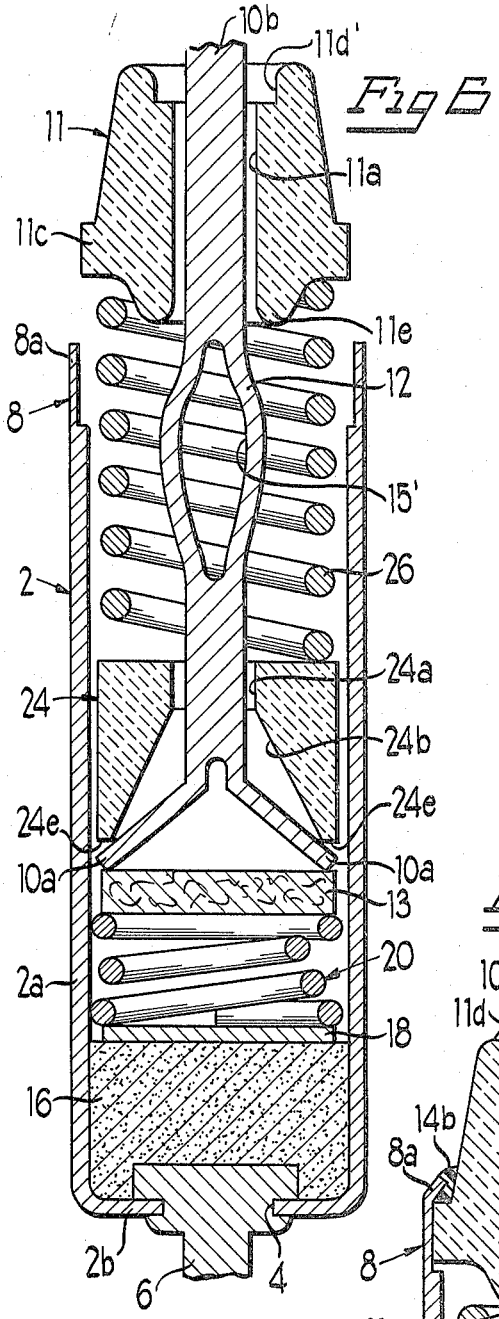
FIG. 6 illustrates the initial step in the assembly of the parts of the cut-off link and shows the insertion of a sandwich of elements loosely within the initially open upper-end of the casing of the cut-off link.
Figure 7:
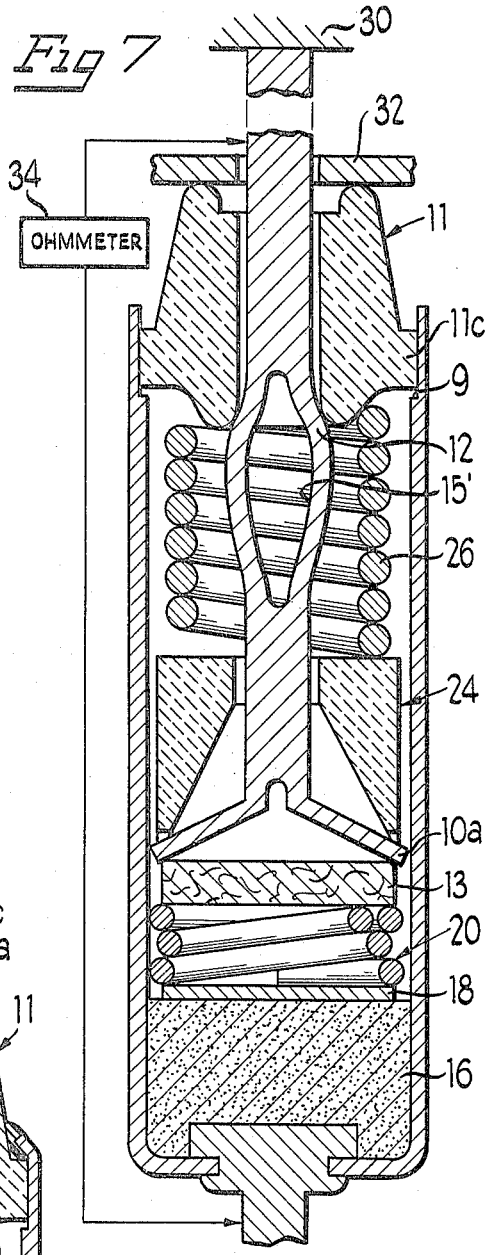
FIG. 7 illustrates the application of external forces upon the closure member and power lead, which forces compress opposed coil springs and expand contact-forming arms of the power lead into a desired contact with the inner walls of the casing, as measured by a ohmmeter diagramatically shown in FIG. 7.
Figure 8:
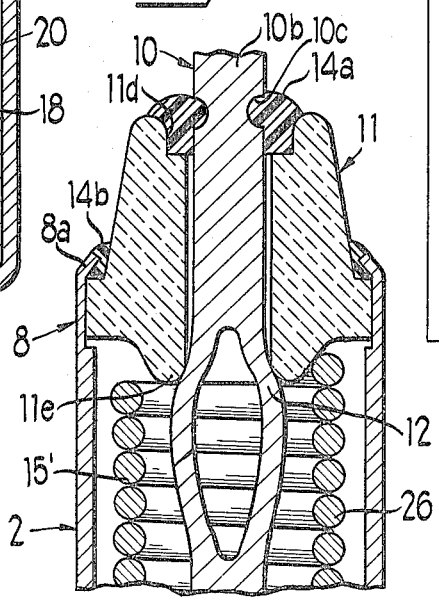
FIG. 8 shows an enlarged sectional view of the upper-end of the cut-off link assembly shown in FIG. 7 after the closure member has been pressed against the power lead and the upper edge of the casing has been crimped tightly around the closure member to fix the position of the closure member, power lead and other elements of said sandwich of elements within the casing, and after the application of an epoxy sealing cement over the exposed points of juncture between the closure member and casing and power lead.

To assemble said sandwich of elements within the casing 2, the casing is oriented so that the initially open end thereof which receives the closure member 11 faces upwardly to receive the different parts of this sandwich of elements dropped into the then bottom portion of the casing in the order in which these elements are to be located within the casing, as shown in FIG. 6. (The pellet 16 however is preferably formed as described by compacting a grannular fuse material into the bottom of the casing 2.) Next, force-applying means, like plunger 32, is brought down against the upper ends of the closure member 11, as shown in FIG. 7. As the plunger 32 is moved downwardly, it compresses the springs 20 and 26 and forces the power lead and contact-forming arms downwardly. The final position of the closure member 11 is determined by the point at which the contact resistance between the contact-forming arms 10a—10a and the casing measured by ohmmeter 34 reaches a desired value. (To ensure uniformity of the control temperatures of identically rated cut-off links, the position of the shoulder 12 of the power lead 10 is selected to achieve the end that the desired contact resistance is obtained before the closure member flange 11c reaches casing shoulder 9). When the ohmmeter measurement reaches the desired resistance, the initially straight end portion 8a of the casing skirt 8 is tightly crimped around the closure member flange 11c. The indentation 10c are completed and globs 14a and 14b of epoxy are placed in the well 11d' between the power lead 10 and closure member 11 and between the casing skirt 8a and the closure member 11, to hermetically seal the initially open end of the casing 2. The epoxy cement, of course, is initially applied in an uncured, softened condition. The cement is then cured by placing the completed cut-off link in an oven and elevating the same to a desired curing temperature. The particular curing temperature utilized depends upon the temperature rating of the cut-off link. Since curing takes at least several hours, the exact time being an inverse function of the curing temperatures, the highest curing temperature is selected that the pellet 16 can safely withstand. The closure member 11 is made of a high temperature resin material which can withstand the curing temperature involved. (For example, in one case, the curing temperature was 66° C. and the curing time of the epoxy cement utilized was 1 hour.) As previously indicated, the curing of globs 14a and 14b of the epoxy cement does not require any special holding fixtures for the cut-off link, which greatly simplifies the curing process as compared to that required for the normally-closed, cut-off links disclosed in my said copending Application Ser. No. 891,020.

It should be apparent that the method and article aspects of the present invention provide a reliable and inexpensive cut-off link and method of making the same, resulting in reliable mass production of cut-off links, with substantially identical operating temperatures.

It should be understood that numerous modifications may be made in the most preferred forms of the present invention described, without deviating from the broader aspects thereof. For example, while the method and article aspects of the present invention are best carried out with the power lead and associated contact-forming arms constituting a single integral unit (i.e. without having any contact interface therebetween), the power lead and contact-forming arms could be made as separate elements and assembled with a contact-forming interface therebetween.

We claim:

1. An ambient thermal actuated cut-off link comprising: a casing of electrically conductive material; a first power lead exposed to the outside of said casing through an opening in said casing at a point where it is insulated therefrom, said first power lead having at the inner end thereof laterally outwardly extending, inwardly deformable contact-forming arm means making a low resistance contact with an inner conductive surface associated with said casing; a second exposed power lead making a permanent low resistance connection with said casing; a sandwich of elements held under spring pressure between spaced points in said casing and comprising stressed spring means, arm-deforming means to be urged by said spring means toward said arm means to deform the same inwardly when the spring means is allowed to move to the unstressed state thereof, backing means for said arm means against which said arm means is urged to expand the same against said casing to establish a given low resistance contact therewith, and a fusible body which melts at a given control temperature, the melting of said body of meltable material at said control temperature causing said spring means to move to an unstressed state to force said arm deforming means against said contact-forming means to bend the same away from said casing; and insulating closure means anchored and sealed in said casing opening, closure means being a rigid member into which said first power lead extends; said first power lead having outwardly facing shoulder means, and the inner portion of said closure means pressing against said shoulder means to force said contact-forming arm means at the inner end of said first power lead against said backing means.

2. The cut-off link of claim 1, wherein a sealing cement covers and seals over adjacent surfaces of said closure means and said casing and first power lead, to hermetically seal the interior of the casing from the surrounding atmosphere.

3. The cut-off link of claim 1 wherein said outwardly facing shoulder means is formed by resilient projecting portions on said first power lead.

4. The cut-off link of claim 3 wherein said power lead includes a shank portion made of a resilient flexible material and having a lateral aperture extending therethrough which has been enlarged to bulge the shank portion laterally outwardly to form said outwardly facing shoulder means.

5. A method of making an ambient thermally actuated switch comprising a casing of electrically conductive material having at least one initially open end portion to receive switch-forming elements during the assembly of the switch; a first exposed power conductor with a projecting shank portion forming a shoulder thereon, portion of said first power conductor being within and insulated from said open portion of said casing, and, said first power conductor having an associated laterally outwardly inclining contact-forming arm means at the inner end thereof which arm means and initially in electrical contact with a conductive surface associated with said casing; a second exposed power conductor electrically connection to said casing; a sandwich of elements extending between the opposite end portion of said casing and a rigid closure member in the open end portion of said casing and a rigid closure member in the open end portion of said casing and a sandwich of elements including arm-deforming means contiguous to one side of said contact-forming arm means and adapted when forced thereagainst with a given force to contract and bend said contact-forming arm means away from said conductive surface, a backing member on the opposite side of contact-forming arm means are forced to expand the same into good electrical contact with said conductive surface, spring means, and a fusible body of material which melts at a given control temperature and holds said spring means in a stressed condition so that when the pellet melts said arm-deforming means is released to contract said arm means out of contact with said conductive surface, a rigid closure member anchored and sealed in the open end of said casing, said closure member maintaining said spring means in said stressed condition and the force of said contact-forming arm means against said backing member; said method comprising: inserting said sandwich of elements and said first power conductor and associated contact-forming means into said casing then externally forcing said closure member against said sandwich of elements and said shoulder of said first power conductor to force said contact-forming arm means toward said backing member, to stress said spring means and force said contact-forming arm means against said backing member so as to expand said contact-forming arm means into forced engagement with said casing, adjusting said force against said first power conductor and contact-forming arm means to a value such that the contact resistance measured between said casing and said contact-forming arm means is at a desirably low pre-determined value, and, while maintaining said adjusted force on said first power conductor, permanently anchoring said closure member over said initially open portion of said casing to fix the stress on said spring means and the pressure of said contact-forming arm means against said conductive surface.

6. The method of claim 5 wherein said closure member is anchored over said initially open portion of said casing by crimping the casing walls snugly around an external portion of the closure member.

7. The method of claim 5 wherein said casing is a cylindrical casing and said conductive surface is the inner surface of said casing.

8. The method of claim 5 wherein said contact-forming arm means is an integral portion of said power conductor so that there is no contact interface between the same.

9. The method of claim 5 wherein said contact-forming arm means incline laterally outwardly in a direction away from said open portion of said casing, said backing member being on the outside of said arm means and said arm-deforming means being on the inside of said arm means, and said contact-deforming arm means being forced inwardly by said externally applied force prior to the anchoring of said closure means.

10. The method of claim 5 wherein, after said closure member has been anchored in place to fix the stress on the spring means and the pressure of said contact-forming arm means against said conductive surface, applying a synthetic plastic material to the lines of juncture between said closure means and said casing and first power conductor, and after releasing the external forces on said closure means and first power conductor, placing the switch in an environment elevated to the curing temperature of said synthetic plastic material.

11. The method of claim 5 wherein sealing cement is placed over adjacent surfaces of said closure member and said casing and first power lead, to hermetically seal the interior of the casing from the surrounding atmosphere.

12. The method of claim 5 wherein said outwardly facing shoulder means if formed by resilient projecting portions on said first power lead.

13. The method of claim 12 wherein said first power lead includes a shank portion made of a resilient flexible material and having a lateral aperture extending therethrough which has been enlarged to bulge the shank portion laterally inwardly to form said shoulder thereon.

* * * * *